United States Patent [19]

Heintz

[11] 4,051,638

[45] Oct. 4, 1977

[54] REMOVABLE ENCLOSURE FOR A SWIMMING POOL OR THE LIKE

[76] Inventor: Robert J. Heintz, 1828 Woodsboro, Royal Oak, Mich. 48067

[21] Appl. No.: 712,022

[22] Filed: Aug. 5, 1976

[51] Int. Cl.[2] ..... E04B 1/347

[52] U.S. Cl. ..... 52/63; 4/172.12; 52/222; 135/3 R; 135/15 CF

[58] Field of Search ..... 4/172.12, 172.13, 172.14; 52/2, 3, 4, 5, 63, 222, 758 F; 135/15 CF, 3 R; 24/263 A, 263 FC, 263 PJ, 263 HW, 243 FS, 243 M, 243 K

[56] References Cited

U.S. PATENT DOCUMENTS

| | | | |
|---|---|---|---|
| 2,976,876 | 3/1961 | Lonnqvist | 135/3 R |
| 3,095,069 | 6/1963 | Winkler | 135/3 R |
| 3,109,440 | 11/1963 | Schjeddahl et al. | 52/2 |
| 3,145,005 | 8/1964 | Wester | 85/9 R |
| 3,424,178 | 1/1969 | Yazaki | 135/5 R X |
| 3,480,023 | 11/1969 | McConnell et al. | 52/2 |
| 3,512,186 | 5/1970 | Sanford | 4/172.12 |
| 3,686,721 | 8/1972 | Nelson | 24/243 K |
| 3,736,754 | 6/1973 | Azalbert et al. | 52/2 |
| 3,777,425 | 12/1973 | Bourgeois | 52/63 X |
| 3,791,076 | 2/1974 | Gahler | 135/3 R |

FOREIGN PATENT DOCUMENTS

| | | | |
|---|---|---|---|
| 1,338,345 | 8/1963 | France | 135/3 R |
| 1,093,367 | 5/1955 | France | 135/3 R |
| 273,640 | 9/1964 | Netherlands | 52/758 F |

*Primary Examiner*—Leslie Braun
*Attorney, Agent, or Firm*—Whittemore, Hulbert & Belknap

[57] ABSTRACT

An enclosure for a swimming pool or the like comprising a cover and a frame for supporting the cover. The frame has a plurality of longitudinally spaced laterally extending ribs which arch over the area to be enclosed and have their ends secured in the ground. The ribs are composed of a plurality of straight elements connected substantially end to end by angularly shaped tubular sections. The frame also has laterally spaced longitudinally extending members interconnecting the ribs. Gripper boards or strips are provided to anchor the cover at the perimeter of the enclosure.

2 Claims, 6 Drawing Figures

REMOVABLE ENCLOSURE FOR A SWIMMING POOL OR THE LIKE

SUMMARY OF THE INVENTION

The enclosure of this invention has a frame which can be reduced in size or enlarged depending upon the area desired to be enclosed. The frame is also constructed so as to have a relatively low profile.

In accordance with a preferred embodiment of the invention which is about to be described, the frame includes a plurality of longitudinally spaced laterally extending ribs which arch over the area to be enclosed and which are composed of a plurality of straight elements connected substantially end to end by angularly shaped tubular sections. Preferably the sum of the angles of the angularly shaped sections of each rib is approximately 180°. Thus the rib ends extend vertically into the ground and the intermediate portions thereof arch over the area to be enclosed. With a given set of the angularly shaped sections, the height and width of the frame may be varied to suit specific doncitions by merely changing the lengths of the straight elements.

The frame also includes the laterally spaced longitudinally extending members which interconnect the ribs preferably by being connected to the angularly shaped tubular sections of the ribs. The interconnection between the longitudinally extending members and the ribs provides lateral stability to the frame.

The frame of the enclosure supports a cover of plastic or like flexible sheet material. Preferably, gripper boards are provided to anchor the perimeter of the cover.

Other objects and features of the invention will become more apparent as the description proceeds especially when taken in conjunction with the accompanying drawings wherein.

Figure 1:
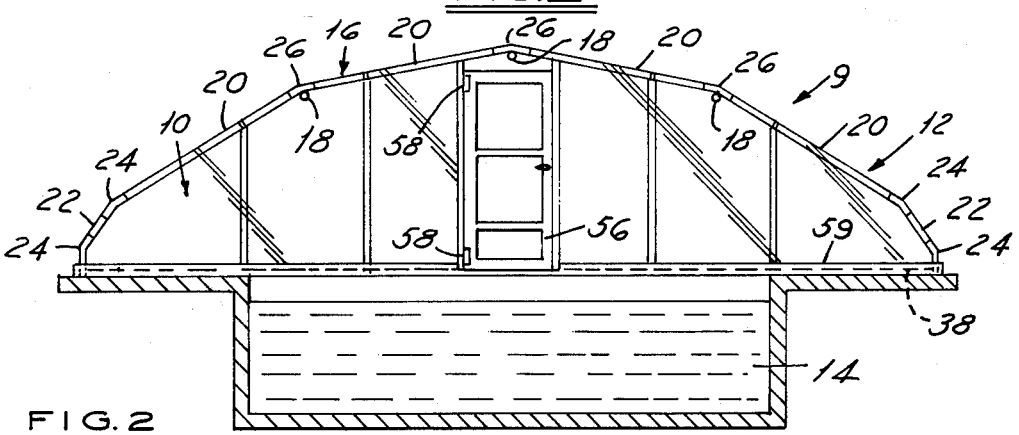
FIG. 1 is an end elevational view of an enclosure constructed in accordance with the invention, shown disposed over a swimming pool.

Referring now more particularly to the drawings, the enclosure is generally designated 9 and broadly comprises a cover 10 and a supporting frame 12. FIG. 1 shows the enclosure disposed over a swimming pool 14, but it should be understood that it may be used for many other purposes.

The frame 12 has a plurality of longitudinally spaced, laterally extending ribs 16 and a plurality of laterally spaced, longitudinally extending members 18.

Figure 2:
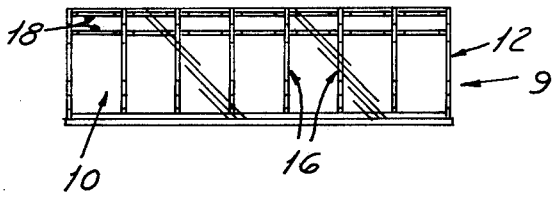
FIG. 2 is a side elevational view of the enclosure on a reduced scale.

The ribs 16 are disposed in parallel vertical planes and preferably are spaced apart equal distances as will be apparent in FIG. 2. Any number of ribs 16 may be employed depending upon the length of the area to be enclosed. Each rib is composed of a plurality of straight elements 20 and 22 and a plurality of angularly shaped tubular sections 24 and 26. The straight elements 20 in this instance are somewhat longer than the straight elements 22. The straight elements 20 and 22 of each rib are connected substantially end to end by the angularly shaped open-ended tubular sections 24 and 26. As shown particularly in FIGS. 3 and 4, the ends of the straight elements telescope within the ends of the tubular sections and are secured thereto as by means of fasteners 28. The two end tubular sections 24 are received in the ground in vertical sockets 30.

Figure 6:
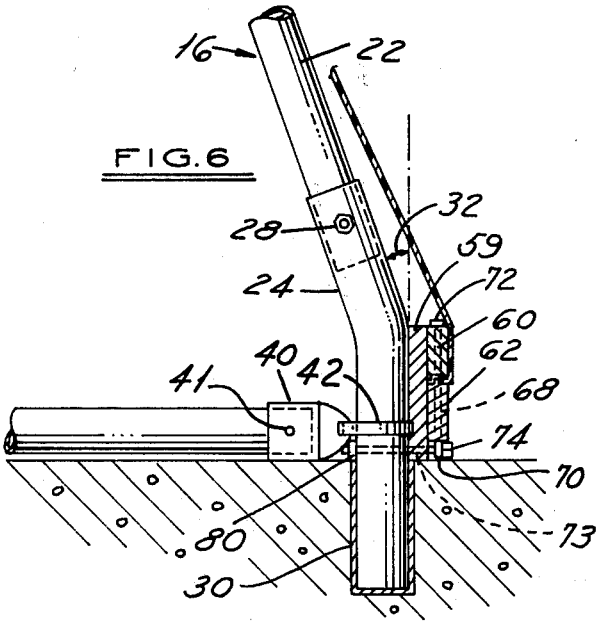
FIG. 6 shows the same structure in elevation and with parts in section.

Each of the four tubular sections 24 is a 30° section, that is, it is bent in the middle 30° away from a straight line. The 30° angle is indicated at 32 in FIG. 6. The remaining three tubular sections 26 of each rib are 20° sections, in other words, they are bent at the middle 20° away from a straight line. The sum of the four 30° angles and the three 20° angles is 180°, and accordingly the two ends of each rib extend into the ground vertically as shown in FIGS. 1 and 6 with the intermediate portion spanning or arching across the space to be enclosed. As seen in FIG. 6, the two end tubular sections 24 each has a vertical leg received in a vertical socket 30 in the ground.

There are in this instance three longitudinally extending members 18 which extend from the front to the rear of the frame. These three members 18 are connected to the tubular sections 26 by means of open-ended cross tubes 34 welded or otherwise permanently secured to the sections 26. These cross tubes 34 extend at right angles to the sections 26 inside the angle formed thereby. The cross tubes 34 connected to the tubular sections 26 at the top of the frame are aligned with one another to receive one of the longitudinal members 18. The cross tubes 34 connected to the tubular sections 26 at each side of the frame are likewise aligned to receive another of the longitudinal members 18. The cross tubes 34 generally form the letter "X" with the tubular sections 26 to which they are secured in all but the front and rear ribs where they form generally the letter "T" as will be apparent in FIG. 2.

Figure 4:
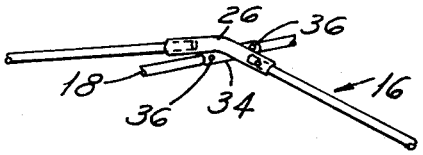
FIG. 4 is a fragmentary detail showing a portion of the frame structure.

Each longitudinal member 18 may be a continuous member extending from front to rear of the enclosure, or it may be made of separate shorter sections or elements for easier assembly and/or removal which are telescoped within the crossing tubes 34 in substantially end to end relation. Fasteners 36 connect the longitudinal members to the cross tubes as seen in FIG. 4.

Figure 3:
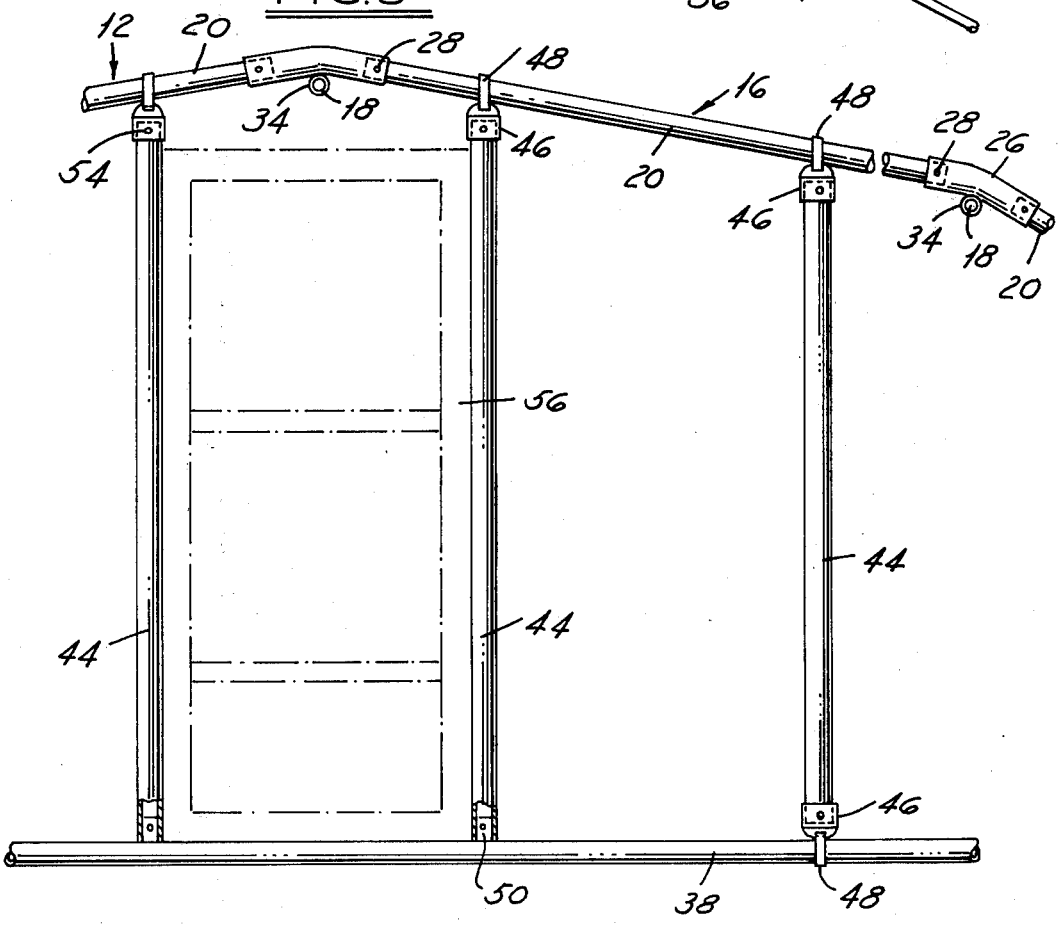
FIG. 3 is an enlarged fragmentary view, omitting the cover, showing a portion of the frame structure of FIG. 1.

At the base of the enclosure at each end thereof there is a horizontal transverse member 38 disposed in the vertical plane of the end rib 16 which extends from one end of the rib to the other as shown in FIGS. 1, 3 and 6. Caps 40 secured as by fasteners 41 to each end of the member 38 are secured to the end tubular sections 24 by straps 42 as seen in FIG. 6 which straps encircle the tubular sections. Laterally spaced vertical posts 44 complete the framing at each end of the enclosure, as shown in FIG. 1, it being understood that the opposite end of the enclosure may be exactly like the end shown in FIG. 1. The upper ends of these posts have caps 46 secured by encircling straps 48 to the elements 20 of the end ribs 16. Similar caps 46 and encircling straps 48 may secure the lower ends of the posts to the cross members 38 as seen in FIG. 3, or alternatively the cross member 38 may have upward projections 50 entering the lower open tubular ends of the posts 44 also as shown in FIG. 3. These projections 50 as well as the caps 46 may if desired be secured to the posts by suitable fasteners 54 or by welding. FIG. 1 shows a door 56 disposed between the centermost posts 44. The door is also shown in dotted outline in FIG. 3. This door may be connected by hinges 58 to one of the posts. The door may be utilized to close the entranceway into the enclosure or it may be omitted altogether, as desired.

A border frame or baseboard 59 of wood for example, extends along the four sides of the enclosure frame at the base thereof, being secured to the rib ends by any suitable means.

Figure 5:
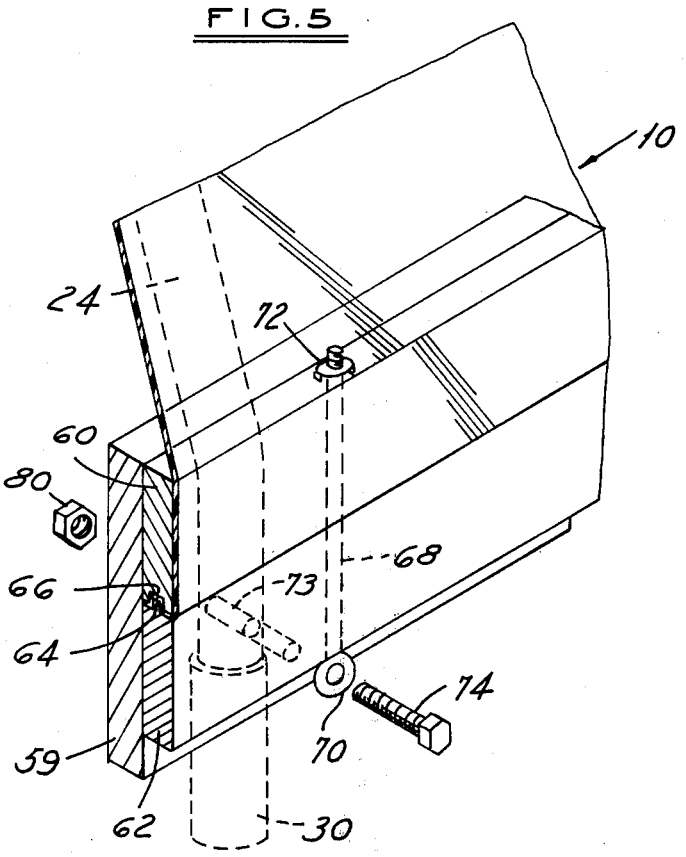
FIG. 5 is a fragmentary perspective view, with parts in section, showing the means for anchoring the cover at the base of the enclosure.

The enclosure cover 10 is preferably of a flexible plastic material which if desired may be transparent or translucent and may consist of a single or double sheet over the entire top and ends of the supporting frame. In other words, the cover can extend over the top of the frame indicated by the rib outline in FIG. 1 and as shown in FIG. 2, and also over the ends of the frame as shown in FIG. 1. Alternatively, the cover may extend over the top of the frame only, with other material such as rigid material covering the ends. Suitable means are provided to anchor the edges of the cover at the base of the frame. FIGS. 5 and 6 show a preferred anchoring means comprising a pair of gripper boards or strips 60 and 62, having tongue and groove formations in the adjacent edges to clamp the lower edges of the cover. As shown, the lower board 62 has a tongue 64 along its upper edge and the upper board 60 has a complementary groove 66 along its lower edge.

One or more eye bolts 68 extend vertically through aligned openings in the two boards having the eye 70 at the bottom and a nut 72 threaded on the top so that when the nut is tightened the two boards are pulled tightly together. A bolt 74 passes through the eye 70 and through the baseboard 59 as well as through a passage 73 in the end tubular section 24 of one of the ribs 18, being secured thereto by the nut 80. It will be understood that two or more of the attaching means including the eye bolt 68, nut 72, bolt 74 and nut 80 will be provided to clamp the gripper boards together at spaced points along their length and to secure them to several of the rib ends as shown in FIG. 6 to provide a secure clamping of the margin of the cover along both sides of the enclosure.

The portions of the cover which extend vertically down across the ends of the enclosure may be anchored at the base by any suitable means and preferably by the same means as shown in FIGS. 5 and 6. Instead of the bolts 74 passing through the rib ends, they will however pass through the cross members 38 when anchoring the portions of the cover which extend over the ends of the enclosure. It will be understood of course that the cover preferably does not cover the doorway controlled by door 56 shown in FIGS. 1 and 3. If the cover were not to cover the ends, but to terminate at the front and rear ribs, the peripheral cover portions may be anchored to those ribs by suitable means such as that shown in FIGS. 5 and 6.

The frame of this enclosure may be enlarged or reduced in size longitudinally as desired by simply adding or subtracting ribs. This will be understood from a consideration of FIG. 2. If more ribs are employed to lengthen the frame, then of course longer longitudinal members 18 must be employed, or if the longitudinal members are made of separate elements arranged end to end then additional elements may be provided. The enclosure has a relatively low profile as seen in FIG. 1. Obviously, if the ribs were arcuate or semi-circular instead of being formed of straight elements connected by angle sections, the profile would be much higher.

The height and width of the frame depends upon the length of the straight elements 20 of the ribs. With a given set of the tubular sections 24 and 26, it will be understood that the height and width of the frame may be varied as desired depending upon specific conditions by merely varying the lengths of the straight elements 20.

The frame of this invention is extremely stable and rigid. One of the reasons for this is the interconnection between the tubular sections 26 and the cross tubes 34 which provide rigid and T-shaped members to link the frame members together into a solid unitary structure.

The gripper boards for securing the margins of the cover are of simple construction and yet provide a firm friction grasp for the cover along the entire lengths of the gripper boards. The gripping of the margin of the cover is uniform throughout the length of the gripper boards which obviously would be in contrast to an anchorage that might for example employ nails or staples to hold the cover.

What I claim as my invention is:

1. An enclosure for a swimming pool or the like, comprising a cover, a frame for supporting said cover, said frame having a plurality of laterally spaced elongated members anchored at their lower end portions to a base along the side of the enclosure, a baseboard extending along the side of the enclosure on the outer side of the lower end portions of said elongated members, and means anchoring said cover at the side of the enclosure comprising upper and lower gripping boards gripping an edge portion of said cover therebetween, said gripper boards being elongated members extending adjacent the outer side of said baseboard and having complementary tongue and groove formations along their adjacent edges gripping said edge portion of said cover, means securing said gripper boards together comprising assembled nuts and bolts, and fasteners passing through one of said gripper boards and passing through said baseboard and connected to the lower end portion of certain of said elongated members to secure the gripper boards and baseboard to said frame.

2. An enclosure as defined in claim 1, wherein said bolts are eye bolts formed with a loop at one end, and said fasteners pass through the loops of said eye bolts.

* * * * *